US011840072B2

(12) United States Patent
Sugiyama et al.

(10) Patent No.: US 11,840,072 B2
(45) Date of Patent: Dec. 12, 2023

(54) PRINTING APPARATUS

(71) Applicant: CANON KABUSHIKI KAISHA, Tokyo (JP)

(72) Inventors: Toshiro Sugiyama, Kanagawa (JP); Yasuyuki Asai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 411 days.

(21) Appl. No.: 17/037,061

(22) Filed: Sep. 29, 2020

(65) Prior Publication Data

US 2021/0101395 A1 Apr. 8, 2021

(30) Foreign Application Priority Data

Oct. 7, 2019 (JP) ..... 2019-184418

(51) Int. Cl.

| | |
|---|---|
| ***B65H 16/00*** | (2006.01) |
| ***B41J 11/00*** | (2006.01) |
| ***B41J 15/04*** | (2006.01) |
| ***B41J 15/02*** | (2006.01) |
| ***B65H 35/00*** | (2006.01) |

(52) U.S. Cl.

CPC ..... *B41J 15/046* (2013.01); *B41J 11/0095* (2013.01); *B41J 15/02* (2013.01); *B65H 16/005* (2013.01); *B65H 35/008* (2013.01)

(58) Field of Classification Search

CPC ..... B65H 2301/4215; B65H 2701/1521

See application file for complete search history.

(56) References Cited

U.S. PATENT DOCUMENTS

| | | | | | |
|---|---|---|---|---|---|
| 4,961,091 | A * | 10/1990 | Kasuya | G03G 15/6552 | 399/405 |
| 5,207,417 | A * | 5/1993 | Bell | B65H 29/40 | 271/220 |
| 5,440,958 | A * | 8/1995 | Terasaki | B65H 31/00 | 271/213 |
| 2009/0127770 | A1* | 5/2009 | Tamaki | B65H 31/26 | 271/207 |
| 2013/0277908 | A1* | 10/2013 | Ueyama | B65H 31/00 | 271/223 |
| 2016/0090262 | A1* | 3/2016 | Wakayama | B65H 31/26 | 271/223 |
| 2016/0355036 | A1* | 12/2016 | Murotani | B41J 11/0095 | |

(Continued)

FOREIGN PATENT DOCUMENTS

JP 2017-226531 A 12/2017

*Primary Examiner* — Jennifer Bahls

(74) *Attorney, Agent, or Firm* — Canon U.S.A., Inc. I.P. Division

(57) ABSTRACT

According to an aspect of the present disclosure, a printing apparatus includes a conveyance unit configured to convey a sheet in a conveyance direction, a print head configured to perform printing on the sheet conveyed in the conveyance direction by the conveyance unit, a discharge port from which the sheet printed by the print head is discharged, a stacking portion located below the discharge port and configured to stack the sheet discharged from the discharge port in a state where a leading end of the sheet is directed to an upstream side in the conveyance direction, and a holding unit disposed in a sheet discharge path below the discharge port and configured to move between a holding position in which the holding unit holds the sheet and a releasing position in which the holding unit releases the sheet.

11 Claims, 10 Drawing Sheets

(56) References Cited

U.S. PATENT DOCUMENTS

| | | | | |
|---|---|---|---|---|
| 2017/0050451 | A1* | 2/2017 | Hayashi | B41J 13/106 |
| 2018/0244086 | A1* | 8/2018 | Yoneyama | B41J 15/046 |
| 2018/0327209 | A1* | 11/2018 | Asai | B65H 23/28 |

* cited by examiner

PRINTING APPARATUS

BACKGROUND

Field

The present disclosure relates to a printing apparatus having a storage portion configured to store a discharged sheet.

Description of the Related Art

A printing apparatus discussed in Japanese Patent Application Laid-Open No. 2017-226531 includes a stacker configured to store a sheet discharged from a discharge port. In the stacker, a leading end of the discharged sheet is directed downward and is abutted on a regulating portion. When the sheet is further discharged in this state, the sheet is bent to a side opposite to the discharge port. Then, a trailing end of the sheet is cut, and thereby the sheet is stacked on an inclined portion. To stack a sheet having a short length on the inclined portion, a height of the regulating portion can be adjusted by a positioning member.

In the configuration discussed in Japanese Patent Application Laid-Open No. 2017-226531, however, it is necessary for a user to manually change a position of the positioning member based on the length of the sheet. The positioning member is also disposed in an inmost part of the stacker, and thus accessibility and workability during user operation are low.

SUMMARY

According to an aspect of the present disclosure, a printing apparatus includes a conveyance unit configured to convey a sheet in a conveyance direction, a print head configured to perform printing on the sheet conveyed in the conveyance direction by the conveyance unit, a discharge port from which the sheet printed by the print head is discharged, a stacking portion located below the discharge port and configured to stack the sheet discharged from the discharge port in a state where a leading end of the sheet is directed to an upstream side in the conveyance direction, and a holding unit disposed in a sheet discharge path below the discharge port and configured to move between a holding position in which the holding unit holds the sheet and a releasing position in which the holding unit releases the sheet.

The present disclosure is directed to a printing apparatus that reduces a load occurring on the user when different sizes of sheets are stored. Further features of the present disclosure will become apparent from the following description of exemplary embodiments with reference to the attached drawings.

DESCRIPTION OF THE EMBODIMENTS (Printing Apparatus)

An exemplary embodiment of the present disclosure is described in detail with reference to drawings. Relative positions and shapes of components described in the following exemplary embodiment are merely illustrative and do not limit the scope of the present disclosure.

Figure 1A:
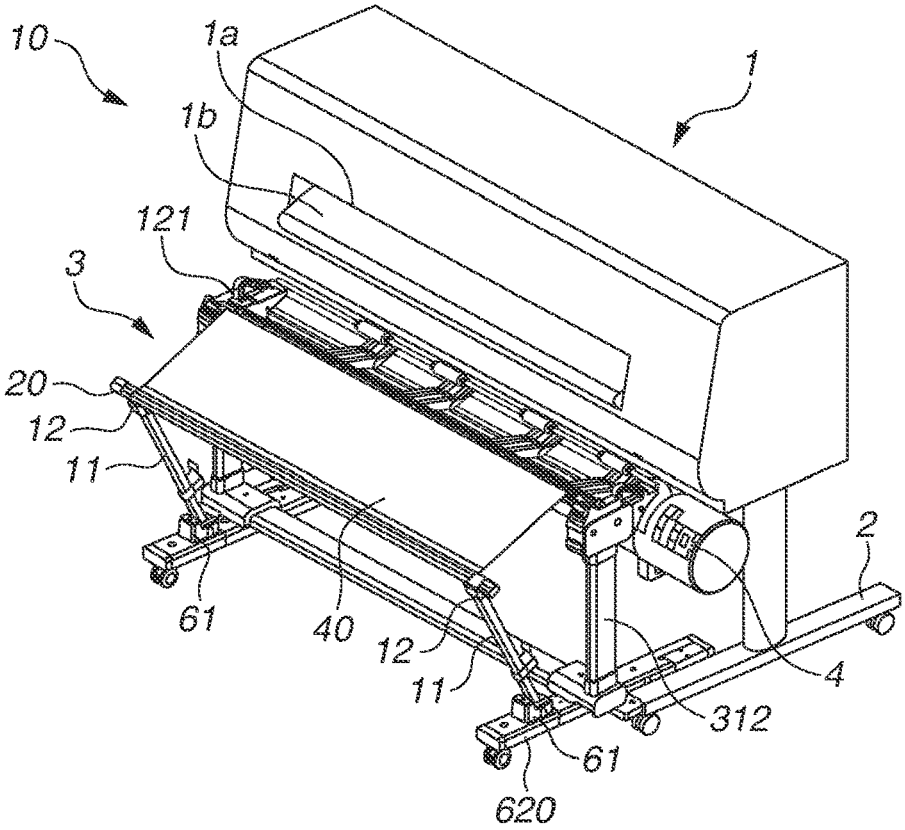
FIG. 1A is a perspective view of a printing apparatus.
Figure 1B:
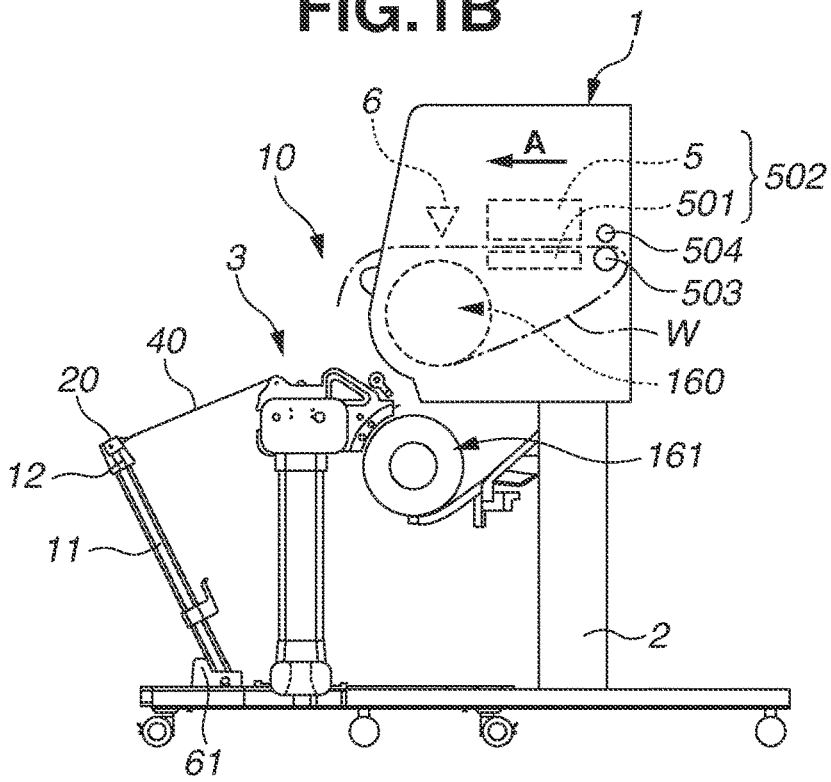
FIG. 1B is a side view of the printing apparatus.
Figure 2:
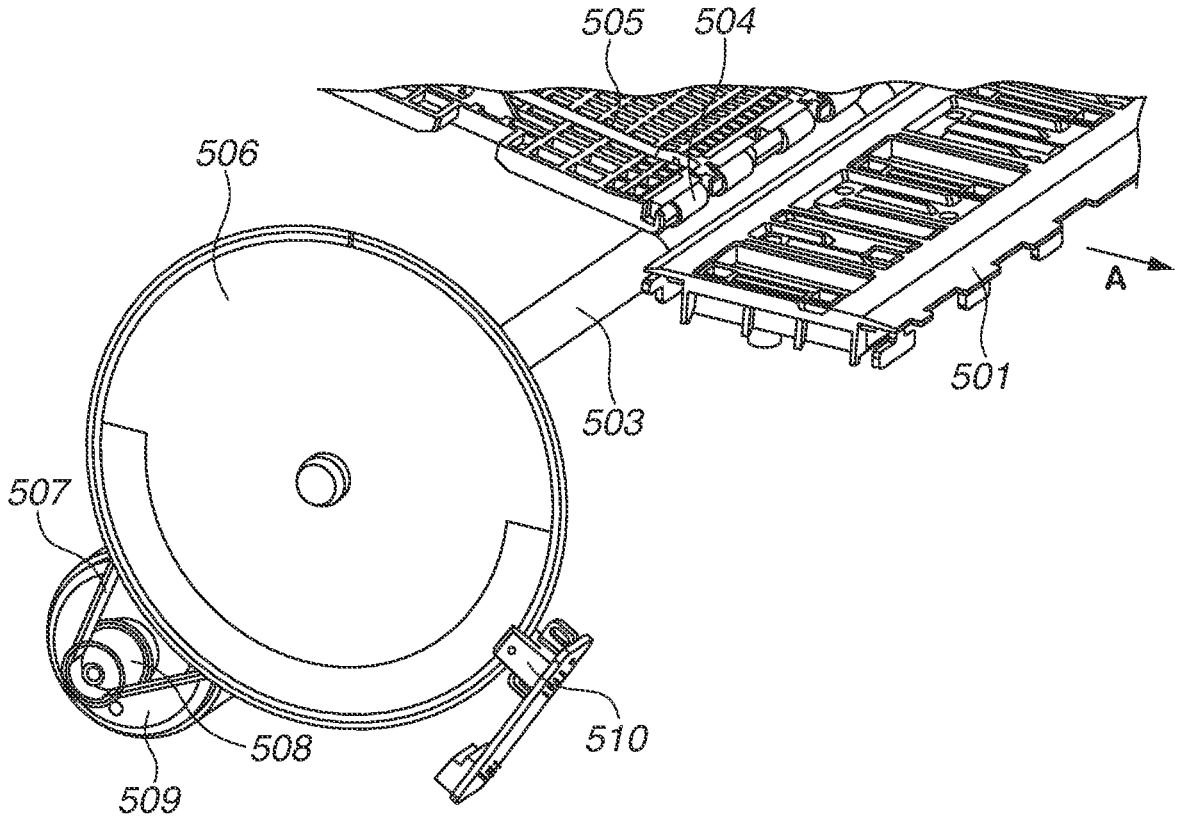
FIG. 2 is an enlarged view of a vicinity of a conveyance roller of the printing apparatus.
Figure 3:
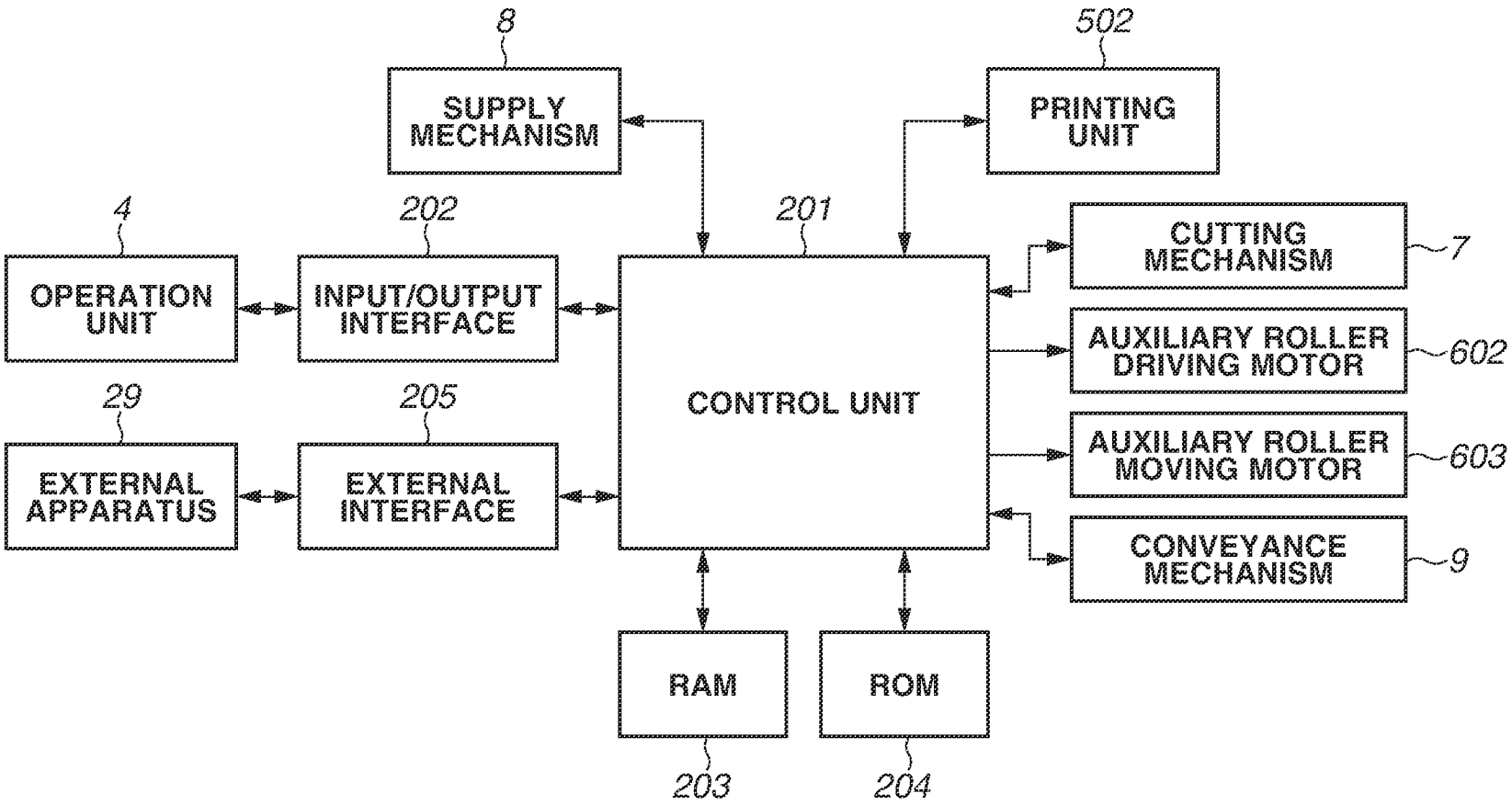
FIG. 3 is a block diagram illustrating a control system of the printing apparatus.

In the present exemplary embodiment, an inkjet printing apparatus is illustrated. FIGS. 1A and 1B illustrate a perspective view of a printing apparatus 10 and a side view of a printing apparatus 10, respectively. FIG. 2 is an enlarged perspective view of a vicinity of a conveyance roller of the printing apparatus 10. FIG. 3 is a block diagram illustrating a control system included in the printing apparatus 10.

The printing apparatus 10 includes a main body 1, a leg portion 2 supporting the main body 1, and a stacker 3 contactable to and separable from the leg portion 2. The main body 1 includes a supply mechanism 8 including roll holding portions 160 and 161, a conveyance mechanism 9 including a conveyance roller 503, a printing unit 502 including a print head 5, and a cutting mechanism 7 including a cutter 6. The roll holding portions 160 and 161 rotatably hold a roll sheet in which a long sheet is wound around a winding core. The roll sheet held by the roll holding portions 160 and 161 is unwound, and is supplied as a sheet W to the conveyance roller 503 through, for example, the supply mechanism 8. The conveyance roller 503 is controlled by the conveyance mechanism 9. The conveyance roller 503 conveys the sheet W to the printing unit 502. The print head 5 of the printing unit 502 prints an image on the conveyed sheet W. A platen 501 supporting the sheet W from below is disposed at a position facing a nozzle surface of the print head 5. An arrow A indicates a conveyance direction in which the sheet W advances on the platen 501 while the printing unit 502 performs printing. In the present exemplary embodiment, the conveyance direction is a horizontal direction directed from a rear surface to a front surface of the printing apparatus 10. The conveyance direction, however, may be a direction having an angle with respect to the horizontal direction. The sheet W on which the image has been printed is conveyed in the conveyance direction while being supported by a discharge guide 1*b*, and is discharged from a discharge port 1*a*.

The cutter 6 included in the cutting mechanism 7 is provided between the print head 5 and the discharge port 1*a*. A trailing end of the sheet W on which the image has been printed is cut at a predetermined cutting position by the cutter 6. The sheet W is gradually discharged from the discharge port 1*a* along with conveyance operation or printing operation until the trailing end is cut. The sheet W thereby changes an advancing direction to a downward direction by its own weight, the sheet W hangs down and proceeds to the stacker 3. The stacker 3 is movable with respect to the printing apparatus 10, and is changeable in a sheet storage mode depending on a type of the sheet W. The roll holding portions 160 and 161 are arranged one above the other in a vertical direction below the discharge port 1*a* on the front surface of the printing apparatus 10. Therefore, after the stacker 3 is moved, a housing can be opened from the front side of the printing apparatus 10, and the roll sheet can be placed on the roll holding portions 160 and 161 provided inside the printing apparatus 10. The main body 1 includes an operation unit 4 provided with various kinds of switches, on a front surface of the main body 1. The user can input various kinds of commands, such as sheet size designation, and online/offline switching, by operating the various kinds of switches.

The stacker 3 is a storage portion storing a sheet in the present exemplary embodiment. The printing apparatus 10 uses a space below the roll holding portion 161 as a part of the storage portion. The stacker 3 includes a sheet-like receptor 40 consisting of a thin, flat, flexible cloth or plastic. The receptor 40 configures a part of a stacking portion according to the present exemplary embodiment. One of ends of the receptor 40 is held by a front rod 20 on a downstream side in the conveyance direction, and the other end is held by an upper rod 121 on an upstream side in the conveyance direction. Both ends of the front rod 20 are coupled with two respective side rods 11 via coupling members 12. The side rods 11 are held by side rod supporting members 61.

FIG. 2 is the enlarged perspective view of the vicinity of the conveyance roller of the printing apparatus 10. The conveyance roller 503 is disposed on the upstream side of the platen 501 in the conveyance direction, and connected to a motor pulley 508 with a belt 507 through a conveyance roller pulley (not illustrated) provided near an end on one side. The motor pulley 508 is attached to a rotary shaft of a roller driving motor 509. The motor pulley 508 transmits driving of the roller driving motor 509 to the conveyance roller 503. The sheet W is conveyed while being held between the conveyance roller 503 and a pinch roller 504. Near the end on the one side of the conveyance roller 503, an encoder film 506 is disposed coaxially with the conveyance roller 503. On the encoder film 506, a plurality of slits are radially printed, and an encoder sensor 510 can detect presence/absence of the slits. Thus, a rotation amount and a phase of the conveyance roller 503 can be detected. A control unit 201 of the printing apparatus 10 can acquire a conveyance amount of the sheet based on the detected rotation amount. A position as a reference of the conveyance amount is, for example, a position detected by a sheet leading-end detection sensor (not illustrated).

The printing apparatus 10 is controlled by the control unit 201. The control unit 201 controls units included in the printing apparatus 10, such as the supply mechanism 8, the cutting mechanism 7, the conveyance mechanism 9, and the printing unit 502, based on control programs stored in a read only memory (ROM) 204. This control includes acquisition of signals from various kinds of sensors, and control of various kinds of motors. The ROM 204 previously stores, for example, a distance on a conveyance path, and rotation amounts of the various kinds of motors for predetermined conveyance. A random access memory (RAM) 203 stores information on various kinds of settings based on user operation. Examples of the various kinds of settings include setting to register a size and a type of the sheet, setting whether to put the printing apparatus 10 into the online state, and setting to switch an operation mode. This Information can be read out as necessary. The control unit 201 is connected to various external apparatuses 29 including a host apparatus, such as a personal computer, through an external interface 205. The control unit 201 can thereby exchange various kinds of information, such as print data, with the external apparatuses 29. For example, when transmitting a print job, each of the external apparatuses 29 also transmits length information on the sheet W to be discharged, together with image data. By controlling the conveyance amount using this information and the encoder sensor 510, the printing apparatus 10 can perform printing of the image and cutting the trailing end of the printed sheet W with the cutter 6.

(Stacker)

Figure 4:
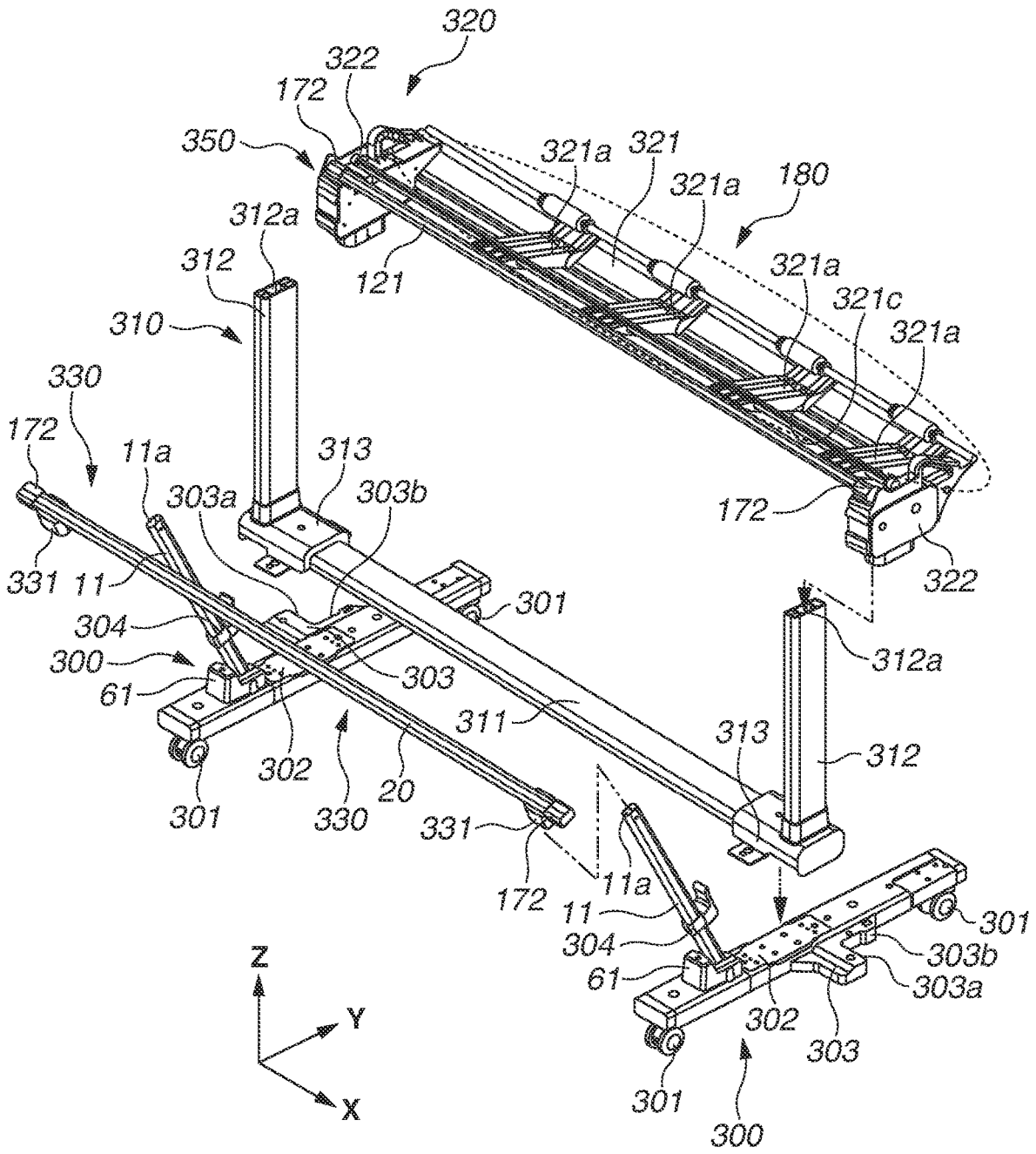
FIG. 4 is a perspective view illustrating a configuration of a stacker.

The stacker 3 storing the sheet is described in detail with reference to FIG. 4. FIG. 4 is a perspective view illustrating a configuration of the stacker 3. In FIG. 4, illustration of the receptor 40 is omitted. The stacker 3 includes a front rod unit 330, an upper rod unit 350, and a backstay unit 320. The upper rod unit 50 and the backstay unit 320 are provided above a foot unit 300 and a stay leg unit 310.

The foot unit 300 includes two casters 301 attached to each of a right foot frame 302 and a left foot frame 302. The foot unit 300 is movable in the X and Y directions illustrated in FIG. 4. The stacker 3 is accordingly contactable to and separable from the main body 1. The X direction corresponds to a sheet width direction, and the Y direction corresponds to the conveyance direction of the sheet. Each of the foot frames 302 includes a contact member 303 to be contacted with the main body 1. A surface 303*a* (Y direction) and a surface 303*b* (X direction) of each of the contact members 303 are abutted on the main body 1. Each of the foot frames 302 includes the side rod supporting member 61 pivotally supporting the corresponding side rod 11. Each of the two side rods 11 is attached with a rod holder 304 to receive the upper rod unit 350. The rod holders 304 are members on which the upper rod unit 350 is placed as necessary when a reception mode of the receptor 40 is changed.

The stay leg unit 310 includes a stay 311 elongated in the X direction and two legs 312 elongated in the Z direction. The stay 311 is coupled with the two legs 312 to form a U-shape. Covers 313 are provided to cover two coupling portions between the stay 311 and the legs 312. The backstay unit 320 includes a backstay 321 elongated in the X direction, and a guide flapper unit 180 (portion surrounded by dashed line illustrated in FIG. 4) disposed on the backstay 321. Two upper rod bases 322 are provided on both ends of the backstay 321. The front rod unit 330 on the downstream side in the conveyance direction includes the front rod 20, rod caps 172 provided at both ends of the front rod 20, and two front rod supports 331. The upper rod unit 350 includes the upper rod 121 and rod caps 172 provided at both ends of the upper rod 121.

Figure 5A:
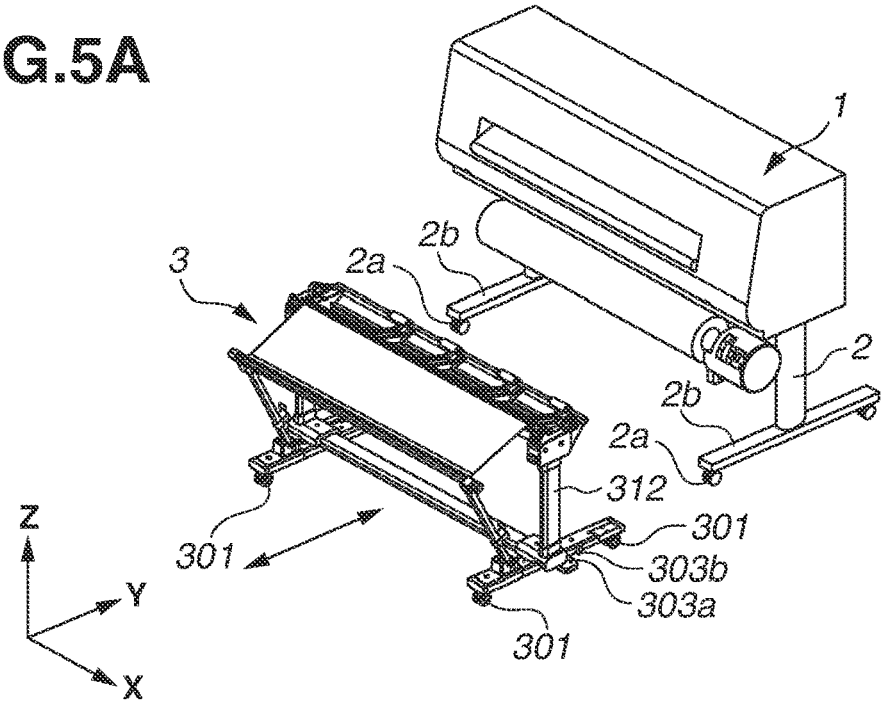
FIGS. 5A, 5B, and 5C are diagrams illustrating positional relationship between the stacker and the printing apparatus.
Figure 5B:
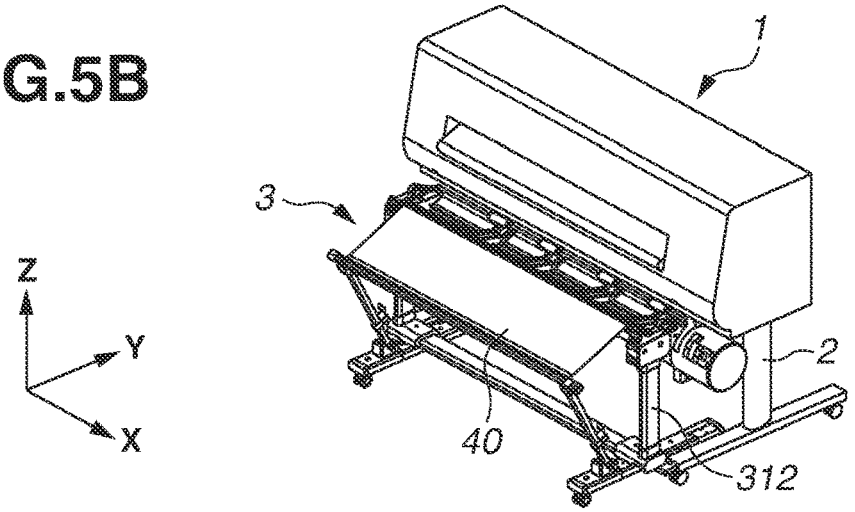
Figure 5C:
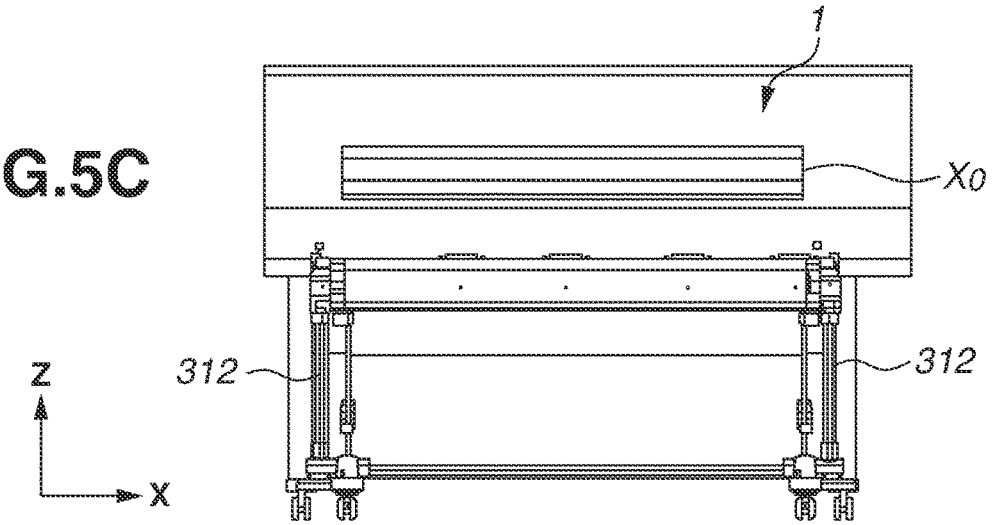

The stacker 3 is used after being moved to a position contacting with the main body 1. Relationship between the stacker 3 and the printing apparatus 10 will be described with reference to FIGS. 5A to 5C. FIG. 5A is a diagram illustrating a state where the stacker 3 is separated from the main body 1. FIG. 5B is a diagram illustrating a state where the stacker 3 is in contact with the main body 1. FIG. 5C is a front view from which illustration of the receptor 40 illustrated in FIG. 5B is omitted. The user uses the stacker 3 while the surfaces 303*a* of the stacker 3 are abutted on respective surfaces 2*a* on the front side of the leg portion 2 of the main body 1. A distance between the right and left surfaces 303*b* is smaller than a distance between inside surfaces 2*b* of the leg portion 2 of the main body 1. Thus, the stacker 3 is movable in the X direction within a predetermined range. When the legs 312 are disposed outside the sheet width, a space on a lower side of the printing apparatus 10 can be effectively used. The space on the lower side of the printing apparatus 10 is used as the storage portion, and thereby allowing for facedown stacking in which a printed surface is hardly damaged. The facedown stacking is a method of stacking the sheets in a print order while each printed surface is directed downward.

(Guide Flapper)

Figure 6A:
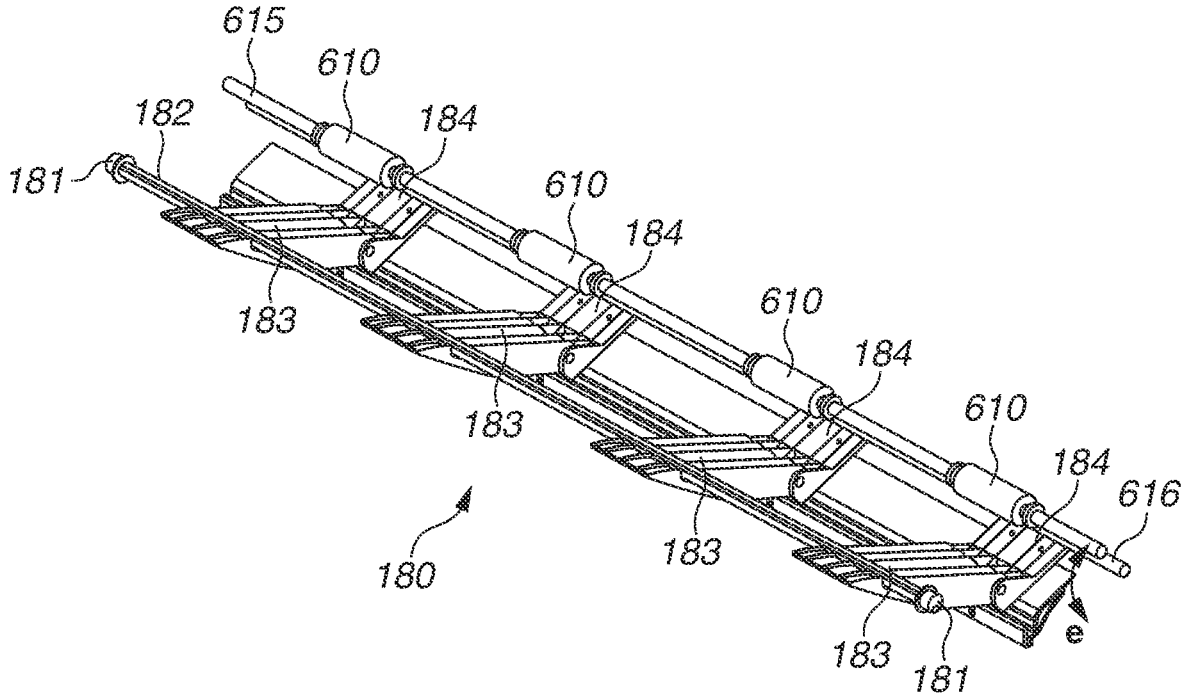
FIGS. 6A and 6B are perspective views illustrating a guide flapper unit.
Figure 6B:
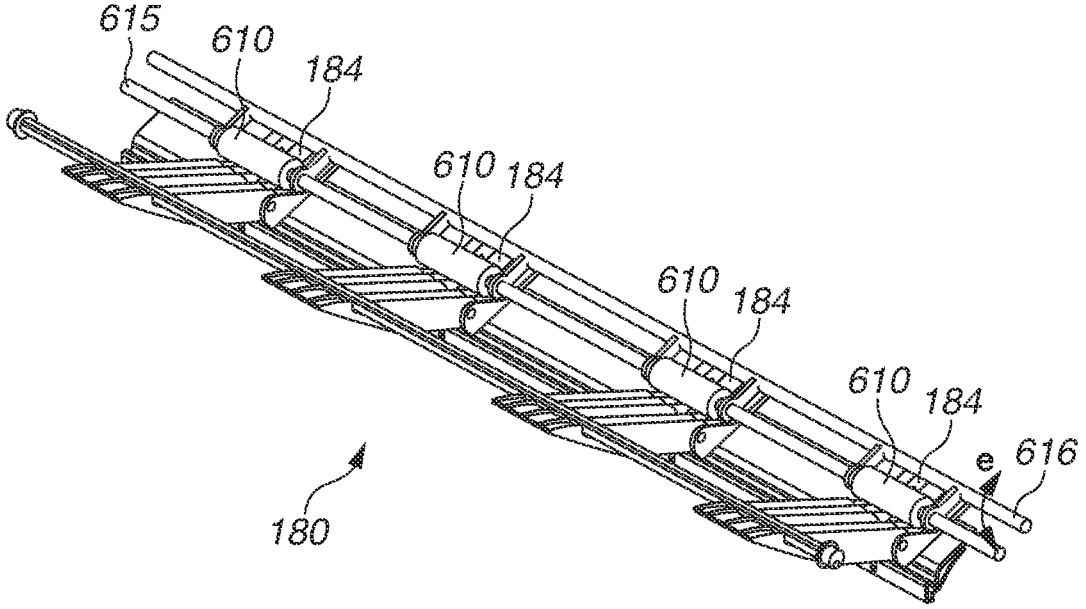

The guide flapper unit 180 will be described in more detail. FIGS. 6A and 6B are partial perspective views of the guide flapper unit 180. In FIGS. 6A and 6B, only necessary portion is illustrated. The guide flapper unit 180 includes a plurality of flappers 183, a plurality of guides 184 attached to the plurality of flappers 183, and a guide rod 182 holding the plurality of flappers 183. The guide rod 182 includes cap members 181 to prevent the user from directly touching both ends. The guide flapper unit 180 can take a state where the flappers 183 are opened and a state where the flappers 183 are closed, by pivotally moving the guide rod 182. When the flappers 183 are opened, the discharged sheet can be stacked on the flappers 183. In contrast, when the flappers 183 are closed, the discharged sheet is guided to a lower side of the roll holding portion 161. In this case, the sheet having a long sheet size can be stacked by using the stacking portion that includes the receptor 40 from the upper rod unit 350 to a second abutting portion below the roll holding portion 161.

A plurality of auxiliary rollers 610 are rotatably provided at positions facing the respective guides 184 on a shaft 615. The auxiliary rollers 610 are made of high friction material, such as rubber. The shaft 615 can be rotated by an auxiliary roller driving motor 602. Further, the auxiliary rollers 610 are rotatable about a pivotal shaft 616. An auxiliary roller moving motor 603 pivotally moves the auxiliary rollers 610 in a direction of arrow e. The auxiliary rollers 610 are thereby contactable to or separable from the guides 184. FIG. 6A illustrates a state where the auxiliary rollers 610 are separated from the guides 184. FIG. 6B illustrates a state where the auxiliary rollers 610 are in contact with the guides 184. The auxiliary rollers 610 are pressed against the guides 184 by urging members (not illustrated) such as springs. The sheet can thereby be held between the guides 184 and the auxiliary rollers 610. In other words, the guides 184 and the auxiliary rollers 610 form a holding unit. In the state where the auxiliary rollers 610 is in contact with the guides 184, the auxiliary rollers 610 hold the sheet with the guides 184. In the state where the auxiliary rollers 610 are separated from the guides 184, the auxiliary rollers 610 release the sheet. When the auxiliary rollers 610 are rotated in the state where the sheet is held, the sheet can be conveyed.

Figure 7A:
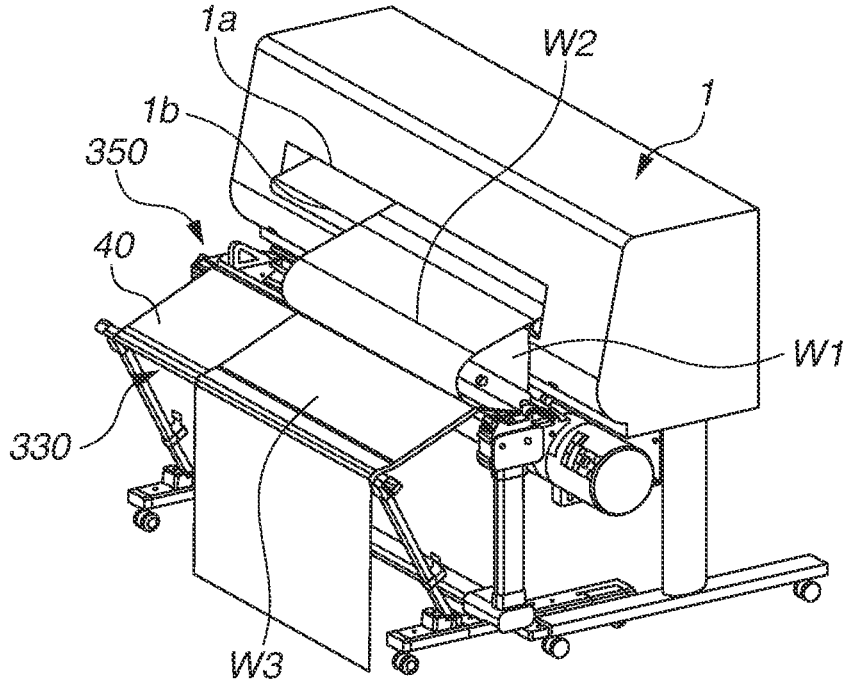
FIGS. 7A, 7B, and 7C are a perspective view, a side view, and a partial detailed view, respectively, illustrating discharge of a sheet.
Figure 7B:
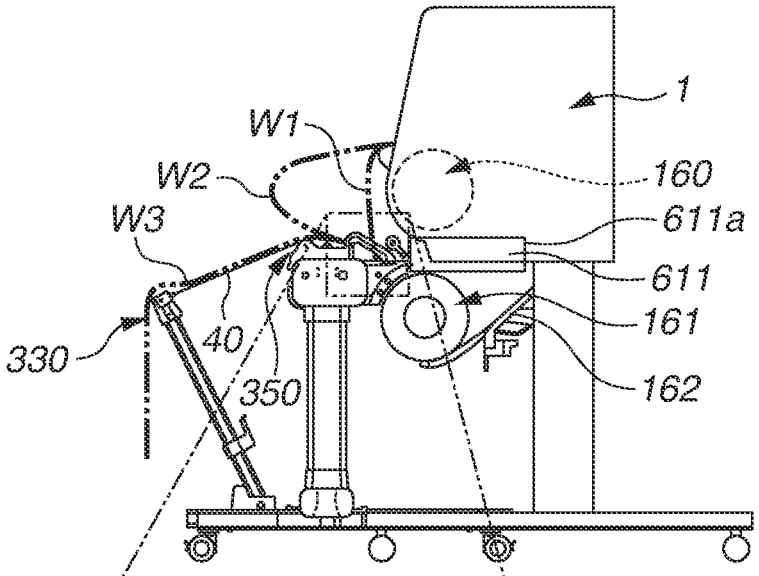
Figure 7C:
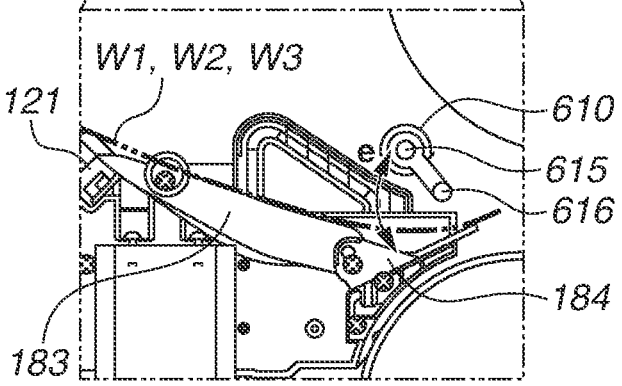

A discharge path of the sheet is now described with reference to FIGS. 7A to 7C. FIGS. 7A, 7B, and 7C are a perspective view, a side vie, and a partial detailed view illustrating discharge of the sheet, respectively. The printing apparatus 10 can change a position where the sheet is held depending on the length of the sheet. Various lengths of sheets can thereby be stacked.

A stacking path 611 is provided in a direction from the guides 184 toward the rear surface of the main body 1. On the rear surface side of the stacking path 611, an abutting portion 611*a* configured to stop an abutted leading end of the sheet is provided. The stacking path 611 is disposed between the upper roll holding portion 160 and the lower roll holding portion 161. A height of the stacking path 611 is determined in consideration of a thickness based on a number of stacked sheets (product of a sheet thickness and the number of stacked sheets) and a curl amount at the leading end of the sheet. The stacking path is a part of the stacking portion of the present exemplary embodiment. Further, the stacking path 611 extends up to an intersection with a supply path 162 of the roll sheet. The auxiliary rollers 610 are provided at the positions facing the respective guides 184 as described above. After the sheet W is held, the sheet W can accordingly be conveyed toward the abutting portion 611*a* of the stacking path 611 by the auxiliary rollers 610.

The flappers 183 each have a gradient rising as separating forward from the front surface side of the printing apparatus 10. This gradient is to guide the leading end of a sheet W1 from the flappers 183 to the guides 184 side and to prevent the sheet W1 from slipping down toward the front side of the printing apparatus 10. Although the flappers 183 each desirably have the rising gradient, the flappers 183 may be provided horizontally. The flappers 183 each have the rising gradient, and the receptor 40 has a falling gradient on the front side of the printing apparatus 10 with the upper rod 350 as an inflection point. The sheet can thereby be stored by being bent in a direction opposite to the curl of the sheet. In other words, the curl in the stored state is straightened to prevent the sheet from curling at the leading end side or the trailing end side. Thus, it is possible to increase stacking efficiency and to increase the stackable number of sheets.

(Control Sequence)

Figure 8A:
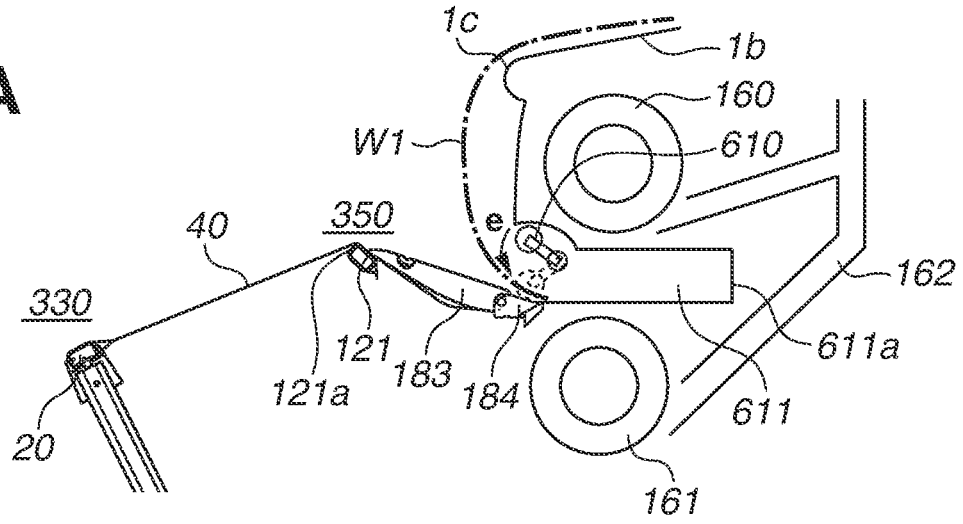
FIGS. 8A, 8B, and 8C are side views illustrating behavior when a large-size sheet is stacked.
Figure 8B:
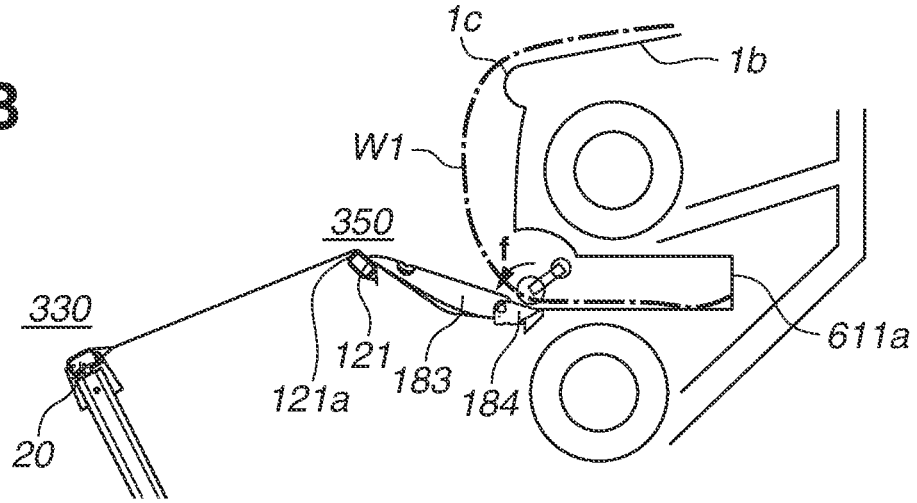
Figure 8C:
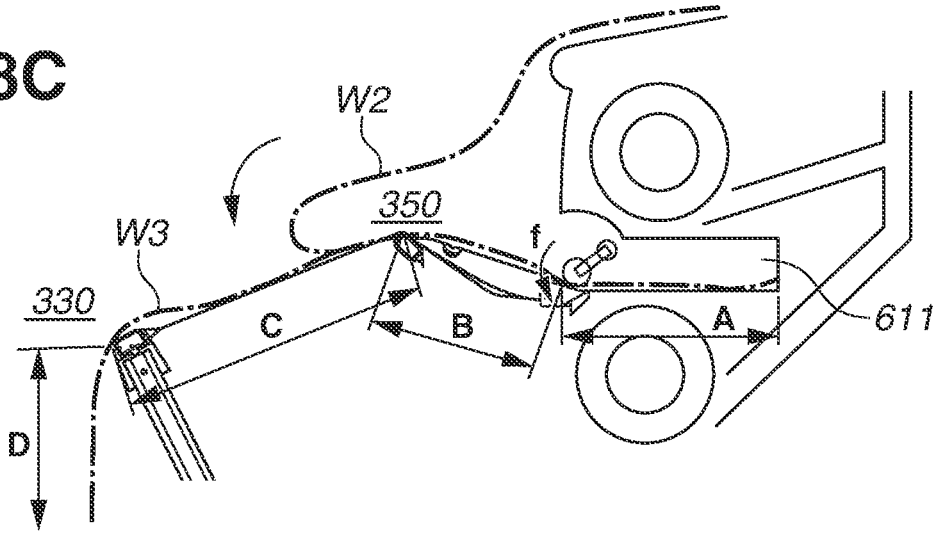
Figure 9A:
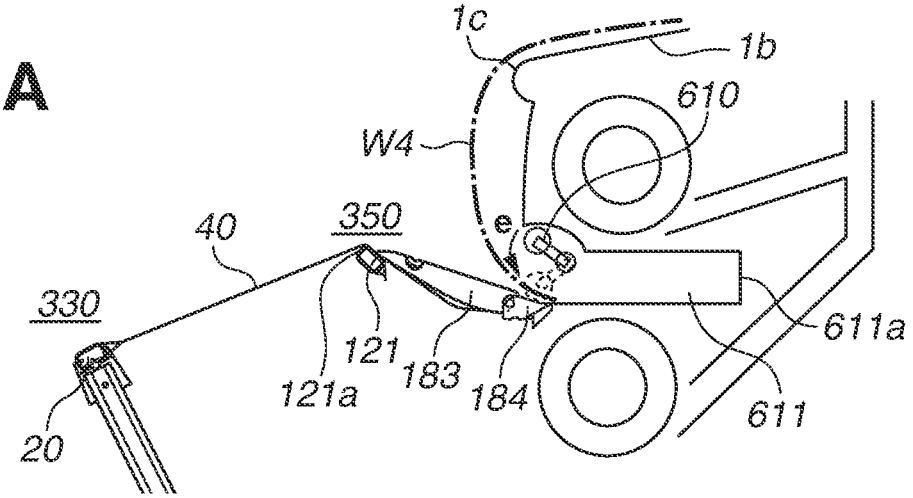
FIGS. 9A, 9B, and 9C are side views illustrating behavior when a small-size sheet is stacked.
Figure 9B:
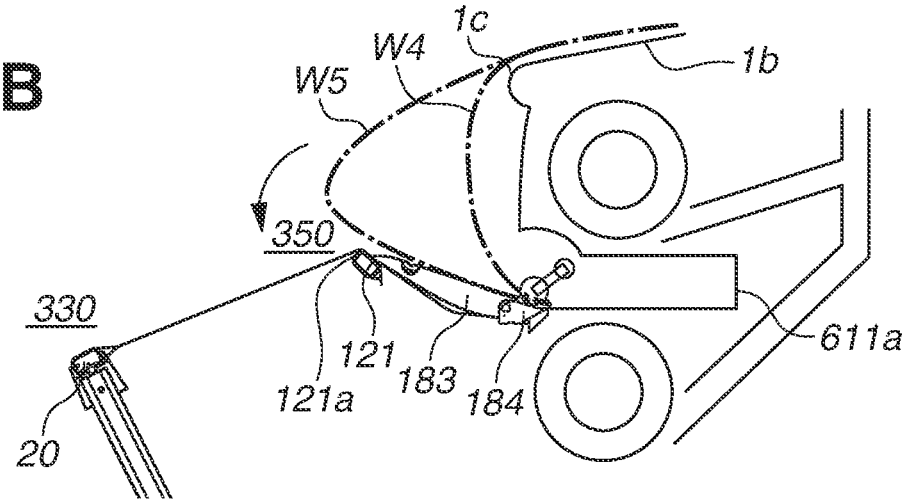
Figure 9C:
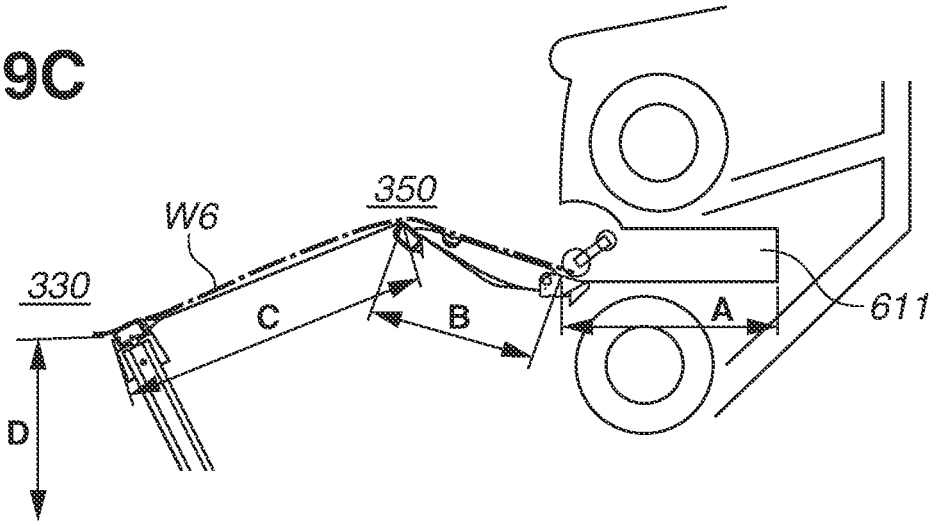
Figure 10:
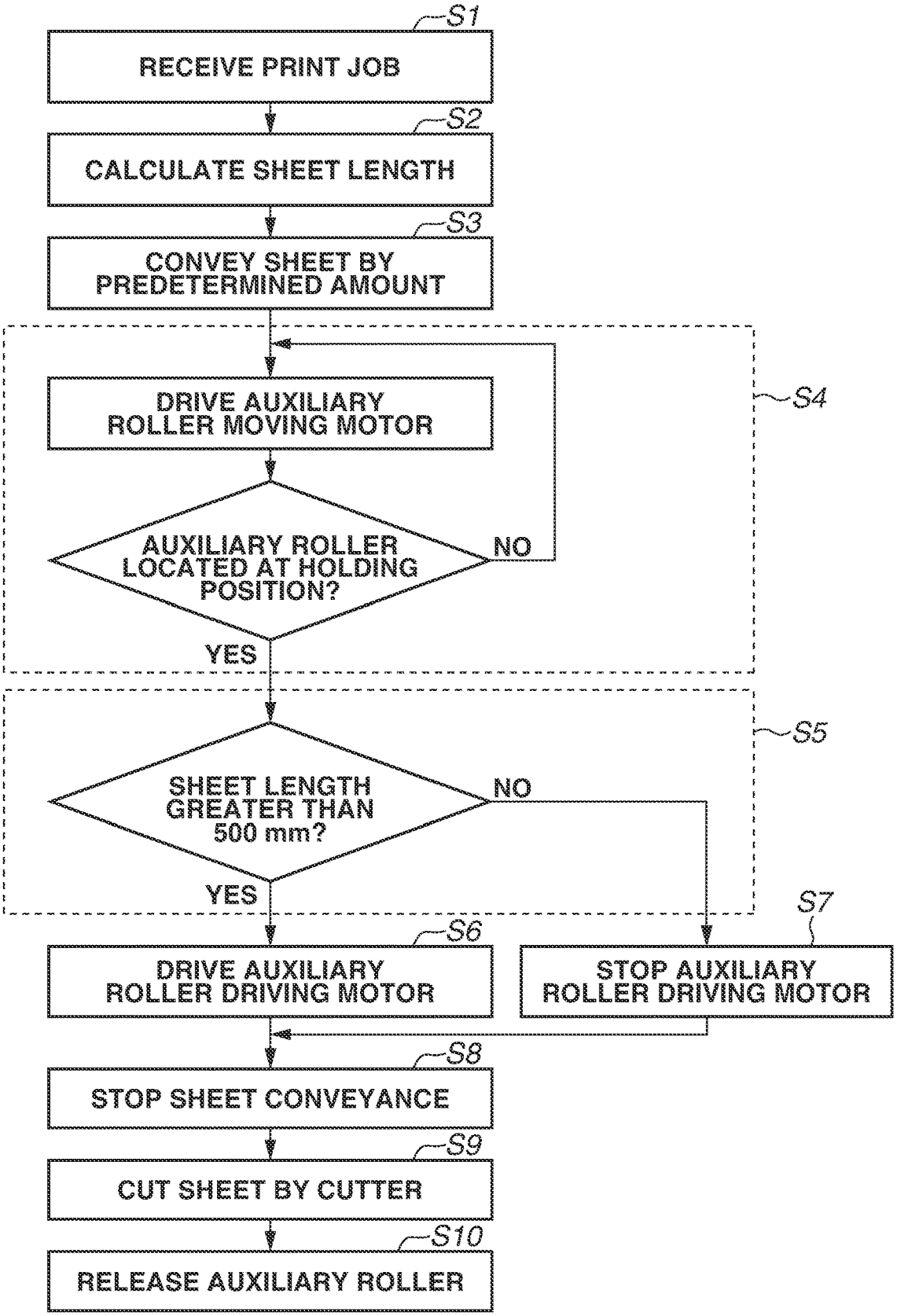
FIG. 10 is a sequence diagram illustrating a control sequence.

A control sequence at the time of discharging the sheet is described. The control sequence is different between a large-size sheet case and a small-size sheet case. The printing apparatus 10 according to the present exemplary embodiment can stack a sheet of a size from a B0 vertical size (1414 mm) to an A2 horizontal size (420 mm). The large-size sheet has a size from a B0 vertical size (1414 mm) to a B2 vertical size (707 mm). The small-size sheet has a size from a B3 vertical size (500 mm) to an A2 horizontal size (420 mm). FIGS. 8A to 8C are schematic views illustrating behavior of a sheet in a case where a large-size sheet is discharged. FIGS. 9A to 9C are schematic views illustrating behavior of a sheet in a case where a small-size sheet is discharged. FIG. 10 illustrates a control sequence at a time of discharging a sheet. The control sequence for the large-size sheet is described, and then, the control sequence for the small-size sheet is described.

In step S1, the printing apparatus 10 receives a print job. In this case, the print job is for a size of B0 vertical size (1414 mm), which is a maximum size, is described.

In step S2, the control unit 201 calculates a length of the sheet to be discharged based on a length of a print image area and a margin added to each of the leading end side and the trailing end side of the image area.

In step S3, the control unit 201 performs the sheet conveyance operation and the printing operation, and conveys the sheet by a predetermined amount. The predetermined amount is based on a conveyance amount conveyed from the reference position. The conveyance amount is detected by an encoder. The leading end of the sheet W1 consequently advances from the discharge port 1*a* while being guided by discharge port guides 1*b* and 1*c*, and reaches the guides 184 through the flappers 183. At this time, the auxiliary rollers 610 are located at the released positions separated from the guides 184 (FIG. 8A).

In step S4, the control unit 201 pivotally moves the auxiliary rollers 610 (in e direction) with the auxiliary roller moving motor 603. The auxiliary rollers 610 thereby move from the released positions to the holding positions. The auxiliary rollers 610 can hold the leading end of the sheet W1 together with the guides 184 because the auxiliary rollers 610 are urged by urging units. After the movement of the auxiliary rollers 610 ends, the processing proceeds to step S5.

In step S5, the control unit 201 determines whether the sheet length calculated in step S2 is greater than 500 mm. If the sheet size is greater than 500 mm (YES in step S5), processing proceeds to step 6. In step S6, discharge processing of a large-size sheet is performed. If the sheet size is 500 mm or less (NO in step S5), processing proceeds to step 7. In step S7, discharge processing of a small-size sheet is performed.

In step S6, the control unit 201 rotates (in f direction) the auxiliary rollers 610 with the auxiliary roller driving motor 602. At this time, conveyance of the sheet W1 and the auxiliary rollers 610 are synchronized with each other to prevent extra tension from being applied to the sheet W1. For example, in printing, the sheet is intermittently conveyed, and thus the auxiliary rollers 610 are also intermittently driven in synchronization with the conveyance. The urging units urge such that conveyance force applied by the auxiliary rollers 610 becomes greater than friction force occurring between the sheet W1 and the guides 184. The leading end of the sheet W1 is thereby conveyed to the rear surface side of the printing apparatus 10 by the conveyance force of the auxiliary rollers 610. When the auxiliary rollers 610 are rotated by the predetermined amount corresponding to the length of the stacking path 611, the leading end of the sheet W1 abuts on the abutting portion 611*a* (FIG. 8B). When the sheet W1 is continuously conveyed in a state where the leading end of the sheet W1 abuts on the abutting portion 611*a* and is regulated, the sheet W1 is supported by the flappers 183, and is discharged while a loop is moved forward. The loop of the sheet is formed on a side separating from the main body 1 with the upper rod unit 305 as an inflection point as with a sheet W2 (FIG. 8C). In this example, the sheet is conveyed until the sheet abuts on the abutting portion 611*a*; however, the sheet may be conveyed to a middle of the stacking path 611 depending on the sheet size.

In step S8, after printing a desired image area, the control unit 201 stops conveyance of the sheet W2 after conveying the sheet W2 by a predetermined amount.

In step S9, the control unit 201 cuts the sheet W2 with the cutter 6 at a cutting position on the trailing end side of the image area. A cut sheet W3 is inverted at the upper rod unit 350 as an inflection point, and is stacked on the receptor 40 while the printed surface is directed downward. In other words, the receptor 40 stretched from the front rod unit 330 to the upper rod unit 350 functions as a stacking portion on which the trailing end side of the sheet W3 is stacked.

In step S10, the control unit 201 drives the auxiliary roller moving motor 603 to move the auxiliary rollers 610 to the released positions. The stacked sheet S3 can thereby be taken out.

The length of the discharged sheet and the length of the stacking portion on which the sheet is stacked will be described. As illustrated in FIG. 8C, the length of the stacking path 611 is A, a length between the stacking path 611 and the upper rod 121 is B, and a length between the upper rod 121 and the front rod 20 is C. A length from the front rod 20 to the ground is D. In this example, these lengths A, B, C, and D are 240 mm, 210 mm, 300 mm, and 700 mm, respectively. In a case of B0 vertical size, a length of the sheet to be stacked on the stacking portion is 750 mm, which is obtained by adding the lengths A, B, and C. A remaining portion of the sheet having a length of 664 mm hangs down from the stacking portion. In other words, a half or more of the B0-size sheet is stacked on the stacking portion of the main body 1. The sheet is thereby stacked without falling from the stacking portion, and the sheet does not contact with the ground. As described above, the large-size sheet can be stacked in a facedown posture without contacting with the ground.

Even in a state where a plurality of sheets is stacked on the receptor 40, the sheet can be stacked in a similar manner. The operation at that time is similar to the above-described operation. More specifically, when the auxiliary rollers 610 are moved down in step S4, the sheet W1 has been already held between the guides 184 and the auxiliary rollers 610 through the stacked sheet. In this case, urging force is set such that the conveyance force applied by the auxiliary rollers 610 becomes greater than the friction force occurring between the sheets. The sheet W1 is reliably conveyed by the conveyance force applied by the auxiliary rollers 610, accordingly. Thus, the plurality of large-size sheets can be stacked in the facedown posture.

The control sequence for the small-size sheet will now be described. Differences from the control sequence for the large-size sheet will be described.

In a case where the control unit 201 determines that the sheet length is 500 mm or less (NO in step S5), the processing proceeds to step S7. In step S7, discharging of a small-size sheet is performed. In this example, a case will be described where the size included in the received job is B3 vertical size (500 mm).

In step S7, the auxiliary rollers 610 stop in a non-driven state. The leading end of a sheet W4 is held, and thus the sheet W4 cannot move (FIG. 9A). When the sheet W4 is conveyed in a state where the leading end of the sheet W4 is held, the sheet W4 is supported by the flappers 183, and is discharged while a loop is moved forward. A loop of the sheet is then formed on a side separating from the main body 1 with the upper rod unit 350 as an infection point as with a sheet W5 illustrated in FIG. 9B.

In step S8, after printing a desired image area, the control unit 201 conveys the sheet W5 by a predetermined amount, and stops conveyance of the sheet W5.

In step S9, the control unit 201 cuts the sheet W5 at a cutting position on the trailing end side of the printed area. The cut sheet is inverted at the upper rod 121 as an inflection point, and is stacked as a sheet W6 while the printed surface is directed downward (FIG. 9C). In other words, the receptor 40 stretched from the front rod unit 330 to the upper rod unit 350 functions as a part of the stacking portion on which the sheet W6 is stacked.

In step S10, the control unit 201 drives the auxiliary roller moving motor 603 to move the auxiliary rollers 610 to the released positions. The stacked sheet W6 can thereby be taken out.

Relationship between the length of the discharged sheet and the length of the stacking portion on which the sheet is stacked will now be described. Since the leading end of the small-size sheet W5 is held by the auxiliary rollers 610, the sheet W5 is stacked on an area of the length B (210 mm) and an area of the length C (300 mm) of the main body 1. In other words, since the length of the sheet W5 is 500 mm, the whole length of the sheet W5 is stacked on the areas having the lengths B and C. The sheet W5 does not hang down from the front rod unit 330 (FIG. 9C), accordingly.

Even in the state where a plurality of sheets is already stacked on the receptor 40, the sheet can be stacked in a similar manner. The operation at this time is similar to the above-described operation. More specifically, when the auxiliary rollers 610 move to the holding positions in step S4, the sheet W is held between the stacked sheet W6 and the auxiliary rollers 610. When the auxiliary rollers 610 stop in this state, the leading end of the sheet W4 can be regulated (FIG. 9B). The plurality of small-size sheets can then be stacked in the facedown posture.

The configuration in which the auxiliary rollers 610 are brought into contact with the guides 184 has been described. In this case, rubbing marks may be generated on the printed surface of the sheet. Therefore, driven rollers may be provided on sides opposite to the auxiliary rollers 610. The flappers 183 have the configuration in which the discharge path can be switched by the user. However, the configuration of the flappers 183 is not limited thereto, and an unswitchable fixed guide may be used or the receptor 40 may be extended. In the present exemplary embodiment, a length boundary between the large-size sheet and the small-size sheet is described as 500 mm; however, the boundary is not limited thereto. An appropriate value is settable as the boundary in consideration of, for example, the stackable sheet length, and the stacking path of the stacker. As described above, even the sheets having the different sheet sizes can be stacked and stored in the stacking portion while the printed surfaces are directed downward. The holding unit can also reduce a load on the user.

According to the present exemplary embodiment, it is possible to reduce the load on the user when the sheets having the different sheet sizes are stored.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-184418, filed Oct. 7, 2019, which is hereby incorporated by reference herein in its entirety.

What is claimed is:

1. A printing apparatus comprising:

a conveyance unit including a conveyance roller to come into contact with a sheet and configured to convey the sheet in a conveyance direction;

a print unit including nozzles for performing printing and configured to perform printing on the sheet conveyed in the conveyance direction by the conveyance unit;

a discharge port from which the sheet printed by the print unit is discharged;

a stacking portion that includes a sheet-like receptor, is located below the discharge port, and is configured to stack the sheet discharged from the discharge port; and a holding unit including a roller, wherein the holding unit is configured to be moveable between a holding position, in which the holding unit holds the sheet by the roller coming into contact with the sheet, and a releasing position, in which the holding unit releases the sheet by the roller separating from the sheet, and a driving unit including a driving motor configured to rotationally drive the roller in a case where the roller is at the holding position, wherein the driving unit rotationally drives the roller in a case where the roller is at the holding position and where the sheet has a length greater than a predetermined length, and the driving unit does not rotationally drive the roller in a case where the roller is at the holding position and where the sheet has a length not greater than the predetermined length.

2. The printing apparatus according to claim 1, further comprising an abutting portion including a wall portion to which a leading end of the sheet discharged from the discharge port is abutted, wherein the abutting portion is disposed on an upstream side of the stacking portion in the conveyance direction.

3. The printing apparatus according to claim 2, wherein the stacking portion includes a flapper configured to be pivotable and a stacking path between the flapper and the abutting portion.

4. The printing apparatus according to claim 2, further comprising:

a first roll holding portion configured to supply a first roll holding portion sheet to the conveyance unit; and a second roll holding portion disposed below the first roll holding portion and configured to supply the sheet to the conveyance unit, wherein the abutting portion is located between the first roll holding portion and the second roll holding portion.

5. The printing apparatus according to claim 1, further comprising a moving unit including a moving motor, wherein the moving unit is configured to move the roller between the holding position and the releasing position.

6. The printing apparatus according to claim 1, wherein, in a case where the sheet has a length less than or equal to a predetermined length, the sheet discharged from the discharge port is stacked on the stacking portion while the holding unit holds a leading end of the sheet.

7. The printing apparatus according to claim 1, further comprising a detection unit including an encoder sensor and configured to detect a conveyance amount of the sheet conveyed by the conveyance unit.

8. The printing apparatus according to claim 7, wherein the holding unit holds the sheet based on the conveyance amount detected by the detection unit.

9. The printing apparatus according to claim 1, wherein the stacking portion is configured to stack the sheet discharged from the discharge port in a state where a leading end of the sheet is directed to an upstream side in the conveyance direction.

10. The printing apparatus according to claim 1, further comprising a sheet discharge path located below the discharge port, wherein the holding unit is disposed in the sheet discharge path.

11. A method for a printing apparatus having a conveyance unit including a conveyance roller to come into contact with a sheet, a print unit including nozzles, a discharge port, a stacking portion that includes a sheet-like receptor and is located below the discharge port, a holding unit including a roller, wherein the holding unit is configured to be moveable between a holding position, in which the holding unit holds the sheet by the roller coming into contact with the sheet, and a releasing position, in which the holding unit releases the sheet by the roller separating from the sheet, the method comprising:

conveying, via the conveyance roller of the conveyance unit coming into contact with the sheet, the sheet in a conveyance direction;

performing printing, via the print unit including the nozzles, on the sheet conveyed in the conveyance direction by the conveyance unit;

discharging the sheet printed by the print unit from the discharge port;

stacking, via the stacking portion including the sheet-like receptor, the sheet discharged from the discharge port;

controlling the driving unit in such a way as to rotationally drive the roller in a case where the roller is at the holding position and where the sheet has a length greater than a predetermined length; and controlling the driving unit in such a way as not to rotationally drive the roller in a case where the roller is at the holding position and where the sheet has a length not greater than the predetermined length.

* * * * *